US010921011B2

(12) United States Patent
Crolius et al.

(10) Patent No.: US 10,921,011 B2
(45) Date of Patent: Feb. 16, 2021

(54) SYSTEMS AND METHODS FOR EFFICIENT AIRFLOW CONTROL IN HEATING, VENTILATION, AIR CONDITIONING, AND REFRIGERATION SYSTEMS

(71) Applicant: TRANE INTERNATIONAL INC., Davidson, NC (US)

(72) Inventors: James P. Crolius, La Crosse, WI (US); Thomas J. Clanin, La Crescent, MN (US); Xin Li, Shanghai (CN)

(73) Assignee: TRANE INTERNATIONAL INC., Davidson, NC (US)

( * ) Notice: Subject to any disclaimer, the term of this patent is extended or adjusted under 35 U.S.C. 154(b) by 11 days.

(21) Appl. No.: 16/370,388

(22) Filed: Mar. 29, 2019

(65) Prior Publication Data

US 2020/0309401 A1 Oct. 1, 2020

(51) Int. Cl.

| | |
|---|---|
| ***F24F 11/74*** | (2018.01) |
| ***F24F 11/47*** | (2018.01) |
| ***F24F 11/63*** | (2018.01) |
| *F24F 110/20* | (2018.01) |
| *F24F 140/60* | (2018.01) |
| *F24F 140/50* | (2018.01) |

(52) U.S. Cl.

CPC ..... *F24F 11/74* (2018.01); *F24F 11/47* (2018.01); *F24F 11/63* (2018.01); *F24F 2110/20* (2018.01); *F24F 2140/50* (2018.01); *F24F 2140/60* (2018.01)

(58) Field of Classification Search

CPC ..... F24F 11/74; F24F 11/47

See application file for complete search history.

(56) References Cited

U.S. PATENT DOCUMENTS

| | | | | |
|---|---|---|---|---|
| 2013/0151019 | A1* | 6/2013 | Federspiel | G05D 23/1934 700/276 |
| 2018/0292103 | A1* | 10/2018 | Modera | F24F 11/79 |
| 2019/0235453 | A1* | 8/2019 | Turney | G06Q 50/06 |

* cited by examiner

*Primary Examiner* — Nathan L Laughlin

(74) *Attorney, Agent, or Firm* — Hamre, Schumann, Mueller & Larson, P.C.

(57) ABSTRACT

This disclosure is directed to systems and methods for determining airflow in a heating, ventilation, air conditioning and refrigeration (HVACR) system to reduce overall power consumption. Methods include receiving efficiency data for one or more compressors of the HVACR system, receiving airflow power consumption data, determining, using a processor, a flow rate based on the efficiency data for the one or more compressors and the airflow power consumption data, and when the HVACR system is in a partial load condition and at least one of the one or more compressors are in operation, operating the HVACR system at the determined flow rate. Systems include one or more compressors, one or more blower fans, and a processor configured to determine an airflow rate for the one or more blower fans based on efficiency data for the one or more compressors and airflow power consumption data.

13 Claims, 3 Drawing Sheets

SYSTEMS AND METHODS FOR EFFICIENT AIRFLOW CONTROL IN HEATING, VENTILATION, AIR CONDITIONING, AND REFRIGERATION SYSTEMS

FIELD

This disclosure is directed to systems and methods for determining airflow in a heating, ventilation, air conditioning and refrigeration (HVACR) system to reduce overall power consumption, particularly determining airflow based on a combination of compressor and fan power consumption at a given flow rate.

BACKGROUND

HVACR systems, such rooftop HVACR systems, are currently operated to reduce fan power consumption by reducing airflow when the systems are at partial loads, i.e. less than the full capacity of the HVACR system. Such airflow reductions are done in both single- and multi-zone variable air volume (VAV) HVACR systems. These airflow reductions may be reductions in flow rate to a minimum design airflow for the HVACR system, for example to maximize the reduction in fan power consumption for the HVACR system.

SUMMARY

This disclosure is directed to systems and methods for determining airflow in a heating, ventilation, air conditioning and refrigeration (HVACR) system to reduce overall power consumption, particularly determining airflow based on a combination of compressor and fan power consumption at a given flow rate.

According to the fan laws, the power required to drive a given airflow through an HVACR system is a cube function of the flow rate for a constant system. Thus, as flow rates are reduced, power savings from reduction in flow rates are subject to diminishing returns.

Further, compressor efficiency and reliability may be adversely affected by low flow rates through HVACR systems. For example, compressors in light and large commercial applications such as 30- and 40-ton HVACR systems can be selected at 200-450 CFM/ton at full load, whereas minimum blower airflows may be as low as 75 CFM/ton or in some systems, even lower. At full load, improved system efficiency is typically achieved between approximately 200-300 cfm/ton, and at light load, for example where compressor capacity is unloaded to 25% for example, total system efficiency may be improved between approximately 125-150 CFM/ton. Energy is wasted if the building system controls airflow below the optimum for the percent compressor capacity. This is because there are diminishing returns to power savings from flow rate reductions, and the losses in compressor efficiency may exceed the reduction in fan power consumption at low flow rates.

Thus, overall HVACR system efficiency can be improved by accounting for both the power savings at the fan and also the compressor efficiency when determining a flow rate to operate at while at least one compressor of the HVACR system is in operation.

A method for controlling flow rate in an HVACR system including one or more compressors and one or more blowers may, in an embodiment, include determining whether the HVACR system is in a partial load condition, determining, using a processor, an operational flow rate based on efficiency data for the one or more compressors and airflow power consumption data for the one or more blowers of the HVACR system, and when the HVACR system is in the partial load condition and at least one of the one or more compressors are in operation, operating the one or more blowers of the HVACR system at the determined operational flow rate.

In an embodiment, the operational flow rate is higher than a minimum flow rate for the blower of the HVACR system.

In an embodiment, the operational flow rate is determined based further on a humidity of air in the HVACR system.

In an embodiment, determining the operational flow rate includes referencing a mathematical model correlating a compressor load with the operational flow rate based on the efficiency data for the one or more compressors and the airflow power consumption data for the one or more blowers of the HVACR system.

In an embodiment, determining the operational flow rate includes receiving the efficiency data for the one or more compressors, receiving the airflow power consumption data, determining a compressor power consumption as a function of a flow rate, based on the efficiency data for the one or more compressors, determining a blower power consumption as a function of the flow rate, based on airflow power consumption data, determining the flow rate having a value for a sum of the compressor power consumption and the blower power consumption that is less than a sum of the compressor power consumption and the blower power consumption at a rated minimum speed of the one or more blowers, and setting the flow rate having the value for a sum of the compressor power consumption and the blower power consumption as the operational flow rate. In an embodiment, the determined flow rate has the smallest value for a sum of the compressor power consumption and the blower power consumption.

In an embodiment, the HVACR system is a single-zone variable air volume HVACR system.

In an embodiment, the HVACR system is a multi-zone variable air volume HVACR system.

An HVACR system embodiment includes a refrigeration circuit including one or more compressors and a heat exchanger, the heat exchanger configured to exchange heat with air within the HVACR system, one or more blowers, and a controller, configured to control the one or more blowers to provide an operational flow rate determined based on efficiency data for the one or more compressors and airflow power consumption data when the HVACR system is in a partial load condition and at least one of the one or more compressors is in operation.

In an embodiment the HVACR system further includes a plurality of VAV terminals, wherein each of the plurality of VAV terminals include dampers. In an embodiment, the processor is configured to receive a state of the dampers of each of the plurality of VAV terminals, and the airflow power consumption data is specific to the state of the dampers of each of the plurality of VAV terminals.

In an embodiment, the operational flow rate is higher than a minimum flow rate for the one or more blowers of the HVACR system.

In an embodiment, the controller is configured to reference a mathematical model correlating a compressor load with the operational flow rate based on the efficiency data for the one or more compressors and the airflow power consumption data.

In an embodiment, the controller is configured to receive the efficiency data for the one or more compressors, receive the airflow power consumption data, determine a compressor power consumption as a function of a flow rate, based on the efficiency data for the one or more compressors, determine a blower power consumption as a function of the flow rate, based on airflow power consumption data, determine the flow rate having a value for a sum of the compressor power consumption and the blower power consumption that is less than a sum of the compressor power consumption and the blower power consumption at a rated minimum speed of the one or more blowers, and set the flow rate having the value for a sum of the compressor power consumption and the blower power consumption as the operational flow rate. In an embodiment, the determined flow rate has the smallest value for a sum of the compressor power consumption and the blower power consumption.

DRAWINGS

DETAILED DESCRIPTION

Figure 1:
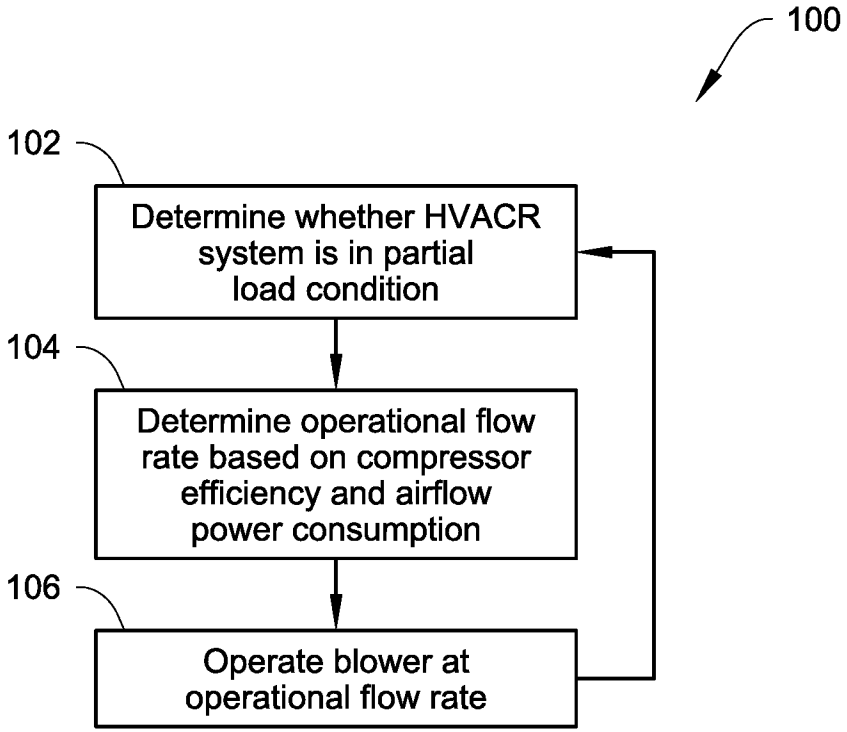
FIG. 1 is a flowchart of a method embodiment for determining airflow in a heating, ventilation, air conditioning and refrigeration (HVACR) system.

This disclosure is directed to systems and methods for determining airflow in a heating, ventilation, air conditioning and refrigeration (HVACR) system to reduce overall power consumption, particularly determining airflow based on a combination of compressor and fan power consumption at a given flow rate.

An HVACR system may be, for example, a rooftop HVACR system providing air to one or more conditioned spaces such as interior spaces in a structure, including but not limited to examples such as floors of an office building, multi-residence buildings, parts of a warehouse, and the like. The air may be distributed by the HVACR system according to airflow control methods, such as single-zone variable air volume (SZVAV) or multi-zone variable air volume (MZVAV) methods. Both SZVAV and MZVAV HVACR systems may include one or more compressors in refrigeration circuits that are used to condition air. SZVAV HVACR systems distribute conditioned air within the single zone. MZVAV methods deliver conditioned air to a plurality of terminal devices, which in turn each may release the conditioned air into a plurality of independent zones within the conditioned space.

The HVACR system may include one or more compressors included in one or more refrigeration circuits to affect the temperature of supply air provided by the HVACR system to the one or more conditioned spaces. The HVACR system may include one or more blower fans configured to drive air through the HVACR system and into the one or more conditioned spaces. The fans may be controllable to vary the flow rate through the HVACR system and into the one or more conditioned spaces, for example by adjusting a speed at which the fan is operated. The HVACR system may take return air from the one or more conditioned spaces and/or outside air ambient to the HVACR system and condition this air prior to providing it to the one or more conditioned spaces.

According to the fan laws, the power required to drive a given airflow through an HVACR system is a cube function of the flow rate for a constant system. Thus, as flow rates are reduced, power savings from reduction in flow rates are subject to diminishing returns. Compressor efficiency at less than maximum load is affected by air flow rates. Compressor efficiency may be improved by flow rates that exceed the minimum design values of variable-speed blowers used in HVACR systems. For example, compressors in light and large commercial applications such as 30- and 40-ton HVACR systems can be selected at 200-450 CFM/ton at full load, whereas minimum blower airflows may be as low as 75 CFM/ton or in some systems, even lower. At full load, improved system efficiency is typically achieved between approximately 200-300 cfm/ton, and at light load, for example where compressor capacity is unloaded to 25% for example, total system efficiency may be improved between approximately 125-150 CFM/ton. Energy is wasted if the building system controls airflow below the optimum for the percent compressor capacity. This is because improvements in compressor efficiency may be more significant for overall energy savings than the reduction in fan power consumption when lowering flow rate, due in part to diminishing returns in fan power savings as air flow rates are reduced.

FIG. 1 is a flowchart of a method embodiment for determining airflow in an HVACR system. Method 100 includes determining whether the HVACR system is in a partial load condition 102, determining an operational flow rate based on efficiency data for the one or more compressors and airflow power consumption data for the one or more blowers of the HVACR system 104, and operating the blower of the HVACR system at the determined operational flow rate 106.

Method 100 includes determining whether an HVACR system is in a partial load condition 102. The load condition of the HVACR system is the capacity at which the HVACR system is operated compared to a maximum or rated capacity. The HVACR system is in a partial load condition when the full capacity of the HVACR system is not being applied to provide heating or cooling to the conditioned space. Examples of partial load conditions can include, but are not limited to when the temperatures inside the conditioned space is near a set point for the HVACR system and not subject to significant external change such as heating or cooling based on ambient conditions. It will be appreciated that a partial load condition may be any condition where the compressors of the HVACR system are between, but not at 0% (compressors off) or 100% (all compressors at maximum load).

In an embodiment, the partial load condition may be part of a cooling schedule for an conditioned space, based on a comparison of the temperature within the conditioned space with the set point for that conditioned space. The comparison of the temperature of the conditioned space and the set point for the conditioned space may be used to generate a discharge air temperature target to bring the conditioned space towards the set point, and a cooling capacity may be determined based on the discharge air temperature target. The determined cooling capacity may dictate whether one or more compressors of the HVACR system are running, and the load condition of the HVACR system, i.e. whether the HVACR system is at partial or full load to provide the discharge air to the conditioned space at the discharge air temperature target.

Method 100 then includes determining an operational flow rate based on efficiency data for the one or more compressors and airflow power consumption data for a blower of the HVACR system 104. The operational flow rate may be, for example, a set value for the flow rate provided by the blower or a value for operational blower speed relative to the maximum blower speed, such as a percentage of the maximum speed.

In an embodiment, determining the operational flow rate includes referencing a mathematical model correlating a compressor load with an operational flow rate based on the efficiency data for the one or more compressors and the airflow power consumption data for the one or more blowers of the HVACR system. The mathematical model may be, for example, a lookup table providing a flow rate for values of compressor load in the HVACR system. In an embodiment, the lookup table may further use one or more factors such as dew point, humidity, dry and wet bulb temperatures, or states of VAV terminals to provide the operational flow rate for a particular compressor load, for example by being a multidimensional lookup table including dimensions for each such factor. In an embodiment, the mathematical model is determined based on simulation data for an HVACR system. In an embodiment, the mathematical model is determined based on compressor data and the fan laws. The mathematical model may include, for example, a determination of compressor power consumption as a function of a flow rate, based on the efficiency data for the one or more compressors and a determination of blower power consumption as a function of the flow rate, based on airflow power consumption data. The efficiency data for the one or more compressors may be based upon the effects of suction temperature on the efficiency of the compressor. The efficiency data for the one or more compressors may correlate compressor efficiency with an operational flow rate by relating the operational flow rate to a suction temperature at the compressor.

In an embodiment, the operational flow rate may be determined at 104 by directly computing power consumption for the one or more compressors and the blower and identifying an operational flow rate providing reduced power consumption via the mathematical model. In an embodiment, determining operational flow rate may include receiving the efficiency data for the one or more compressors, receiving the airflow power consumption data, determining a compressor power consumption as a function of a flow rate, based on the efficiency data for the one or more compressors, determining a blower power consumption as a function of the flow rate, based on airflow power consumption data, determining the flow rate having a value for a sum of the compressor power consumption and the blower power consumption that is less than a sum of the compressor power consumption and the blower power consumption at a minimum speed of the blower, and setting the operational flow rate at the determined flow rate. In an embodiment, the flow rate having the smallest value for a sum of the compressor power consumption and the blower power consumption may be selected as the operational flow rate. It will be appreciated that the flow rate having a value that may be less than but other than the smallest value may be selected as the operational flow rate to achieve system design and/or operation goals. It will be appreciated that, for example, a reduction of the flow rate can be optimized to select for the smallest value or other value that is not the smallest value in order to achieve system design and/or operation goals. The efficiency data for the one or more compressors may include a function for power consumption as a function of compressor load and airflow over a heat exchanger of a refrigeration circuit including the one or more compressors. The efficiency data for the one or more compressors may account for particular conditions such as humidity, dew point, wet and dry bulb temperatures and other such factors affecting compressor power consumption. The airflow power consumption data may be, for example, the fan laws and a reference value for power consumption and flow rate. In an embodiment, the airflow power consumption data is a function associated with a particular state of multiple variable air volume (VAV) terminal, each connected to a different zone of the conditioned space.

In an embodiment, the HVACR system is a single-zone variable air volume (SZVAV) HVACR system. In an SZVAV HVACR system, the fan laws may be used as the airflow power consumption data, to compute the power consumed by the fans at a given flow rate. The fan laws express the power required to drive a given airflow through an HVACR system as a function of the flow rate in an SZVAV HVACR system. The relationship between flow rate and power consumption expressed in the fan laws may be incorporated into the mathematical model referenced to determine the operational flow rate, for example being used to compute fan power consumption as a function of flow rate when preparing a lookup table used to correlate compressor load and operational flow rate. In an embodiment, the fan laws are used to determine blower power consumption directly based on airflow power consumption data. The airflow power consumption data may be, for example, a reference value for power consumption at a given flow rate. The airflow power consumption data may be, for example, flow rate and power consumption data such as current flow rate and power consumption or historical data regarding flow rate and power consumption.

In an embodiment, the HVACR system is a multi-zone variable air volume (MZVAV) HVACR system. MZVAV systems include multiple terminals including dampers, and thus the system may be changed in ways that affect the applicability of the fan laws based on the state of the dampers at the terminals. In MZVAV systems, the controller may be in communication with the multiple terminals to receive and/or control the state of the dampers. The state of the dampers may be used to select a particular mathematical model to be used for determining blower power consumption when determining operational flow rate at 104. In an embodiment, the dampers of the terminals in an MZVAV HVACR system may be controlled to select damper positions that are consistent with efficient compressor and fan operations.

Once an operational flow rate is determined at 104, the method 100 proceeds to operating the HVACR system at the determined flow rate 106. Operating the HVACR system at the determined operational flow rate 106 may be performed, for example, by directing a speed of the more blowers of the HVACR system via a controller.

When the HVACR system is operated at the desired flow rate 106, the method 100 may return to 102 to iterate. Such iterations may be based on the passage of time such as periodic or schedule iterations, or iterations triggered by an event or alarm, such as a change in a load condition of the HVACR system. The load condition of the HVACR system may, for example, be monitored continuously or periodically. In an embodiment, the method 100 is iterated at discrete times, e.g. at a regular interval such as every ten to sixty seconds or other such defined times or ranges of times.

Figure 2:
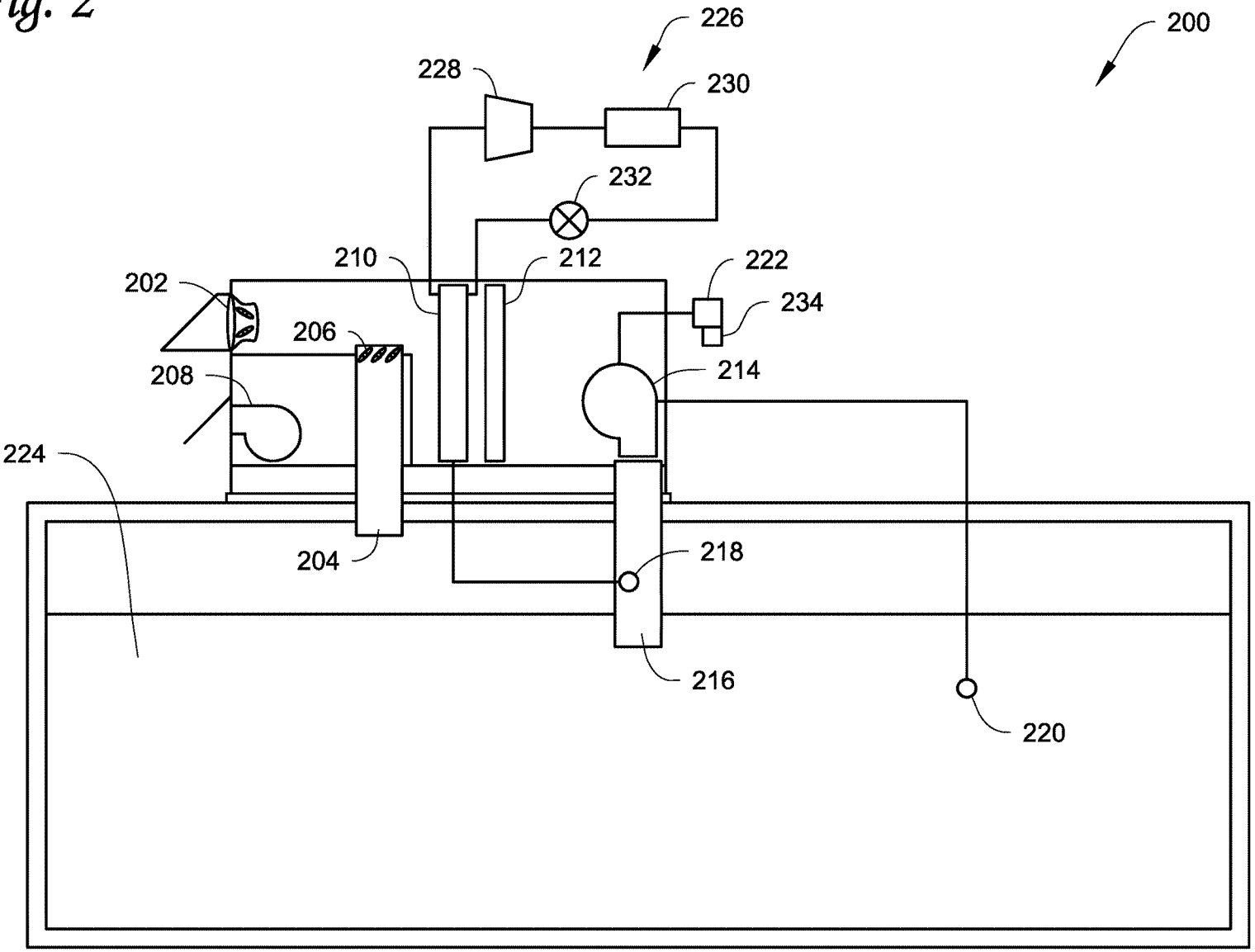
FIG. 2 is schematic diagram of a single zone variable air volume (SZVAV) HVACR system according to an embodiment.

FIG. 2 is schematic diagram of a single-zone variable air volume (SZVAV) HVACR system according to an embodiment. SZVAV HVACR system 200 includes outside air intake 202, return air duct 204, dampers 206, exhaust blower 208, cooling heat exchanger 210, heating heat exchanger 212, supply blower 214, supply air duct 216, supply air temperature sensor 218, zone temperature sensor 220, and controller 222. SZVAV HVACR system 200 provides air conditioning to conditioned space 224. Refrigeration circuit 226 provides cooled refrigerant to cooling heat exchanger 210.

Outside air intake 202 includes one or more inlets allowing ambient air from outside the SZVAV HVACR system 200 and the conditioned space 224 to enter the SZVAV HVACR system 200.

Return air duct 204 conveys air from the conditioned space 224 into the SZVAV HVACR system 200. Return air from return air duct 204 passes to dampers 206. When dampers 206 are open, they allow at least some of the return air to mix with air from outside air intake 202 and the mixed air proceeds to cooling heat exchanger 210.

Exhaust blower 208 may direct some, or if dampers 206 are closed, all of the return air from return air duct 204 to exit the SZVAV HVACR system 200, directing the air to the ambient environment.

Cooling heat exchanger 210 exchanges heat between a refrigerant and air passing through SZVAV HVACR system 200. Cooling heat exchanger 210 is part of refrigeration circuit 226, where it acts as an evaporator transferring heat away from air passing over it to evaporate refrigerant.

Heating heat exchanger 212 may be included in SZVAV HVACR system 200 to optionally transfer heat to the air passing through SZVAV HVACR system 200. Heating heat exchanger 212 may be heated by, for example, a heat pump system, one or more furnace burners, electric heating, or any other such source of heating.

Supply blower 214 may include, for example, an axial fan, a centrifugal blower, or any other suitable air moving device. Supply blower 214 is configured to drive air flow through SZVAV HVACR system 200. Supply blower 214 may, for example, draw or blow air through cooling heat exchanger 210 and heating heat exchanger 212 and drive the air into conditioned space 224 via supply air duct 216. Supply blower 214 may be a variable speed supply blower. Supply blower 214 may be a stepped blower. In an embodiment, supply blower 214 includes a plurality of fans which may be individually controlled to vary airflow generated by supply blower 214.

Supply air duct 216 conveys air driven by supply blower 214 to the conditioned space 224. Supply air temperature sensor 218 may be located within supply air duct 216 to measure an air temperature of the supply air being provided by SZVAV HVACR system 200 to conditioned space 224.

Conditioned space temperature sensor 220 may be located in conditioned space 224 to provide temperature measurements from within the conditioned space 224, for example for control of SZVAV HVACR system 200 based on the temperature of conditioned space 224 with respect to a set point.

Controller 222 is a controller operatively connected to at least supply blower 214 to control the speed of supply blower 214. Controller 222 may be operatively connected to compressor 228 to receive an operational status of the compressor 228, such as the loading state of the compressor 228 or whether compressor 228 is in operation. Controller 222 may be operatively connected to a memory 234. Memory 234 may be configured to store data such as efficiency data for compressor 228, airflow power consumption data for variable speed supply blower 214, fan law equations, and other such data that may be used by controller 222. Controller 222 may perform the method described above and shown in FIG. 1.

Conditioned space 224 receives air conditioned by SZVAV HVACR system. Air within conditioned space 224 is conditioned by, for example, SZVAV HVACR system 200 providing fresh air and/or adjusting a temperature and/or humidity within the conditioned space 224. Air from conditioned space 224 may enter return air ducts 204.

Refrigeration circuit 226 includes compressor 228, condenser 230, and expansion device 232. In an embodiment, refrigeration circuit 226 includes cooling heat exchanger 210 as an evaporator. Compressor 228 may be, for example, a screw compressor or a scroll compressor. Compressor 228 may be operated at a capacity less than its maximum capacity. Compressor 228 may have an efficiency that varies with the flow rate of air through SZVAV HVACR system 200. Compressor 228 compresses a refrigerant, which then travels to condenser 230 where it is condensed by releasing heat to an ambient environment. The refrigerant then passes from condenser 230 to expansion device 232, which expands the refrigerant. Expansion device 232 may be, for example, an expansion valve, orifice, or other suitable expander to reduce pressure of a refrigerant. The refrigerant from expansion device 232 then travels to cooling heat exchanger 210, where it absorbs heat from the ambient air before returning to compressor 228.

Figure 3:
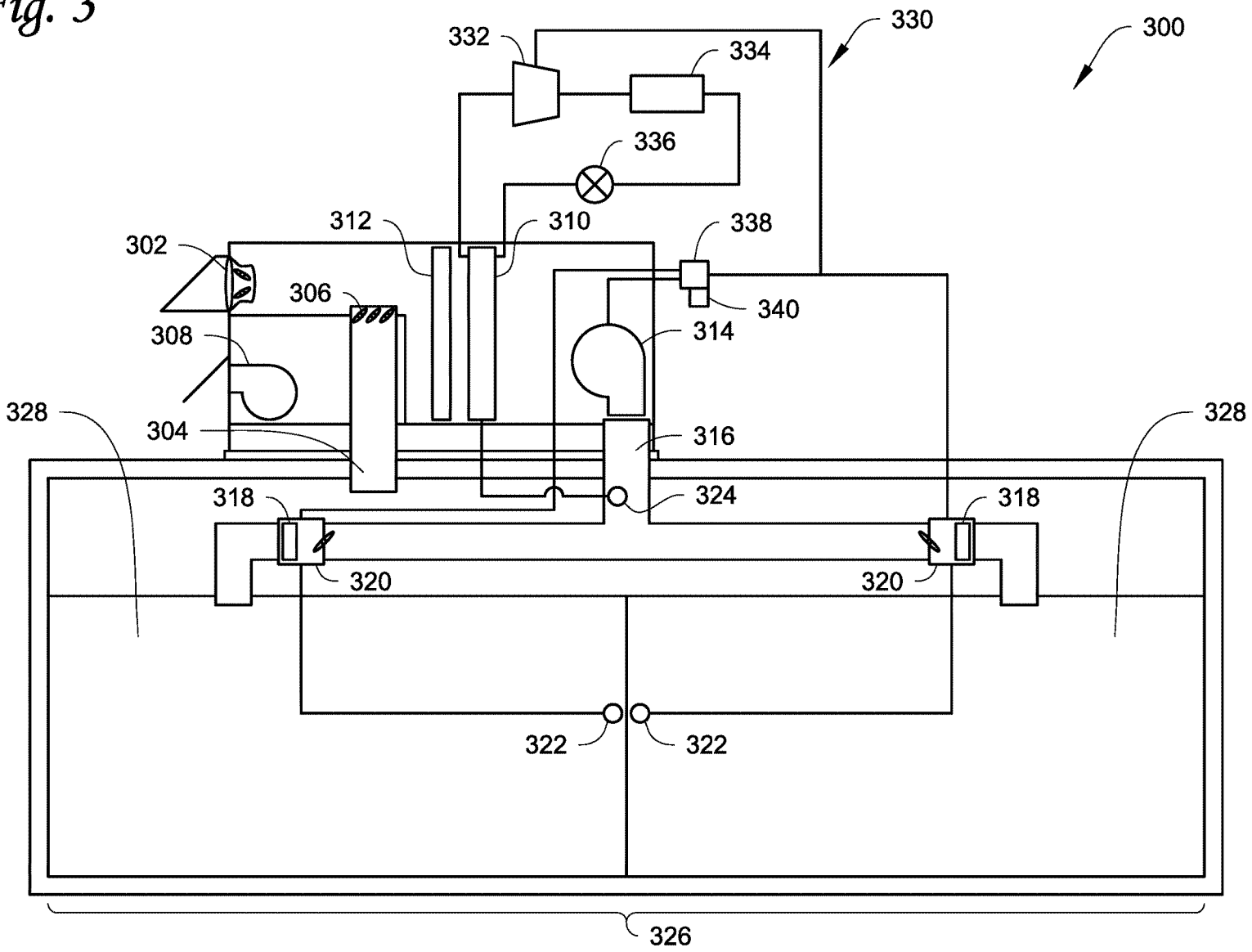
FIG. 3 is a schematic diagram of a multi-zone variable air volume (MZVAV) HVACR system according to an embodiment.

FIG. 3 is a schematic diagram of a multi-zone variable air volume (MZVAV) HVACR system according to an embodiment. MZVAV HVACR system 300 includes outside air intake 302, return air duct 304, dampers 306, exhaust blower 308, cooling heat exchanger 310, heating heat exchanger 312, supply blower 314, supply air duct 316, VAV terminals 318, supply air temperature sensor 320, zone temperature sensors 322, and controller 338. MZVAV HVACR system 300 provides air conditioning to conditioned space 326, which is divided into zones 328. Refrigeration circuit 330 provides cooled refrigerant to cooling heat exchanger 310. Controller 338 is connected to at least supply blower 314.

Outside air intake 302 is one or more inlets allowing ambient air from outside the MZVAV HVACR system 300 and the conditioned space 326 to enter the MZVAV HVACR system 300.

Return air duct 304 conveys air from the conditioned space 326 into the MZVAV HVACR system 300. Return air from return air duct 304 passes to dampers 306. When dampers 306 are open, they allow at least some of the return air to mix with air from outside air intake 302 and the mixed air proceeds to cooling heat exchanger 310.

Exhaust blower 308 may direct some, or if dampers 306 are closed, all of the return air from return air duct 304 to exit the MZVAV HVACR system 300, directing the air to the ambient environment.

Cooling heat exchanger 310 exchanges heat between a refrigerant and air passing through MZVAV HVACR system 300. Cooling heat exchanger 310 is part of refrigeration circuit 330, where it is an evaporator transferring heat away from air passing over it to evaporate refrigerant.

Heating heat exchanger 312 may be included in MZVAV HVACR system 300 to optionally transfer heat to the air passing through MZVAV HVACR system 300. Heating heat exchanger 312 may be heated by, for example, a heat pump system, one or more furnace burners, electric heating, or any other such source of heating.

Supply blower 314 may include, for example, an axial fan, a centrifugal blower, or any other suitable air moving device. Supply blower 314 is configured to drive air flow through MZVAV HVACR system 300. Supply blower 314 may, for example, draw or blow air through cooling heat exchanger 310 and heating heat exchanger 312 and drive the air into conditioned space 326 via supply air duct 316. Supply blower 314 may be a variable speed supply blower.

Supply blower 314 may be a stepped blower. In an embodiment, supply blower 314 includes a plurality of fans which may be individually controlled to vary airflow generated by supply blower 314.

Supply air duct 316 conveys air driven by supply blower 314 to the VAV terminals 318. Supply air temperature sensor 324 may be located within supply air duct 316 to measure an air temperature of the supply air being provided by MZVAV HVACR system 300 to VAV terminals 318.

A plurality of VAV terminals 318 receive air from the supply air duct 316. Each of the VAV terminals 318 includes a set of dampers 320 controlling flow through the VAV terminal 318 and into the zone 328 of the conditioned space 326 serviced by that particular VAV terminal 318. By closing dampers 320, flow to a particular zone 328 may be restricted. MZVAV HVACR system 300 may alter the flow paths for air through the state of dampers 320, and thus different damper configurations may change the applicability of fan laws to relating air flow rates and power consumption.

Zone temperature sensors 322 may be located in each of zones 328 to measure temperatures within those zones. The temperature readings from zone temperature sensors 322 may be used to control MZVAV HVACR system 300, for example to adjust the supply air temperature or to control the dampers of one or more of the VAV terminals 318 based on the temperatures of one or more of zones 328 of conditioned space.

Conditioned space 326 is divided into zones 328. Each of zones 328 includes at least one VAV terminal 318. The conditioned space receives air from the VAV terminal 318. The air received from the VAV terminal 318 conditions the air, by, for example, providing fresh air and/or adjusting a temperature and/or humidity within the zone 328 of conditioned space 326. Air from conditioned space 328 may enter return air ducts 304.

Refrigeration circuit 330 provides cooled refrigerant to cooling heat exchanger 310. Refrigeration circuit 330 includes compressor 332, condenser 334, and expansion device 336. In an embodiment, refrigeration circuit 330 includes cooling heat exchanger 310 as an evaporator. Compressor 332 may be, for example but is not limited to, a screw compressor or a scroll compressor. Compressor 332 may be operated at a capacity less than its maximum capacity. Compressor 332 may have an efficiency that varies with the flow rate of air through MZVAV HVACR system 300. Compressor 332 compresses a refrigerant, which then travels to condenser 334 where it is condensed by releasing heat to an ambient environment. The refrigerant then passes from condenser 334 to expansion device 336, which expands the refrigerant. Expansion device 336 may be, for example, an expansion valve, orifice, or other suitable expander to reduce pressure of a refrigerant. The refrigerant from expansion device 336 then travels to cooling heat exchanger 310, where it absorbs heat, cooling the air to be provided by MZVAV HVACR system 300, before returning to compressor 332.

Controller 338 is a controller operatively connected to at least variable speed supply fan 314. Controller 338 may be configured to receive the state of the dampers 320 of the plurality of VAV terminals 318, which may be used when determining an operational flow rate for the variable speed supply fan 314 to be operated at. Controller 338 may be operatively connected to compressor 332, so that controller 338 may receive the operational status of compressor 332, such as, for example, whether the compressor 332 is in operation and what load it is operating at. Controller 338 may be operatively connected to a memory 340. Memory 340 may be configured to store data such as efficiency data for compressor 332, airflow power consumption data for variable speed supply blower 314, fan law equations, and other such data that may be used by controller 338. Controller 338 may perform the method described above and shown in FIG. 1 for MZVAV HVACR system 300.

Aspects:

It is understood that any of aspects 1-8 can be combined with any of aspects 9-15.

Aspect 1. A method for controlling flow rate in a heating, ventilation, air conditioning and refrigeration (HVACR) system including one or more compressors and one or more blowers, comprising:

determining whether the HVACR system is in a partial load condition;

determining, using a processor, an operational flow rate based on efficiency data for the one or more compressors and airflow power consumption data for the one or more blowers of the HVACR system; and when the HVACR system is in the partial load condition and at least one of the one or more compressors are in operation, operating the one or more blowers of the HVACR system at the determined operational flow rate.

Aspect 2. The method according to aspect 1, wherein the operational flow rate is higher than a minimum flow rate for the one or more blowers of the HVACR system.

Aspect 3. The method according to any of aspects 1-2, wherein the operational flow rate is determined based further on a humidity of air in the HVACR system.

Aspect 4. The method according to any of aspects 1-3, wherein determining the operational flow rate comprises referencing a mathematical model correlating a compressor load with the operational flow rate based on the efficiency data for the one or more compressors and the airflow power consumption data for the one or more blowers of the HVACR system.

Aspect 5. The method according to any of aspects 1-3, wherein determining the operational flow rate comprises:

receiving the efficiency data for the one or more compressors;

receiving the airflow power consumption data;

determining a compressor power consumption as a function of a flow rate, based on the efficiency data for the one or more compressors;

determining a blower power consumption as a function of the flow rate, based on airflow power consumption data;

determining the flow rate having a value for a sum of the compressor power consumption and the blower power consumption that is less than a sum of the compressor power consumption and the blower power consumption at a rated minimum speed of the one or more blowers; and setting the flow rate having the value for a sum of the compressor power consumption and the blower power consumption as the operational flow rate.

Aspect 6. The method according to aspect 5, wherein the determined flow rate has the smallest value for a sum of the compressor power consumption and the blower power consumption.

Aspect 7. The method according to any of aspects 1-6, wherein the HVACR system is a single-zone variable air volume HVACR system.

Aspect 8. The method according to any of aspects 1-6, wherein the HVACR system is a multi-zone variable air volume HVACR system.

Aspect 9. A heating, ventilation, air conditioning, and refrigeration (HVACR) system, comprising:

a refrigeration circuit including one or more compressors and a heat exchanger, the heat exchanger configured to exchange heat with air within the HVACR system;

one or more blowers; and a controller, configured to control the one or more blowers to provide an operational flow rate determined based on efficiency data for the one or more compressors and airflow power consumption data when the HVACR system is in a partial load condition and at least one of the one or more compressors is in operation.

Aspect 10. The HVACR system according to aspect 9, further comprising a plurality of VAV terminals, wherein each of the plurality of VAV terminals include dampers.

Aspect 11. The HVACR system according to aspects 10, wherein the processor is configured to receive a state of the dampers of each of the plurality of VAV terminals, and the airflow power consumption data is specific to the state of the dampers of each of the plurality of VAV terminals.

Aspect 12. The HVACR system according to any of aspects 9-11, wherein the operational flow rate is higher than a minimum flow rate for the one or more blowers of the HVACR system.

Aspect 13. The HVACR system according to any of aspects 9-12, wherein the controller is configured to reference a mathematical model correlating a compressor load with the operational flow rate based on the efficiency data for the one or more compressors and the airflow power consumption data.

Aspect 14. The HVACR system according to any of aspects 9-13, wherein the controller is configured to:

receive the efficiency data for the one or more compressors;

receive the airflow power consumption data, determine a compressor power consumption as a function of a flow rate, based on the efficiency data for the one or more compressors;

determine a blower power consumption as a function of the flow rate, based on airflow power consumption data;

determine the flow rate having a value for a sum of the compressor power consumption and the blower power consumption that is less than a sum of the compressor power consumption and the blower power consumption at a rated minimum speed of the one or more blowers; and set the flow rate having the value for a sum of the compressor power consumption and the blower power consumption as the operational flow rate.

Aspect 15. The HVACR system according to aspect 14, wherein the determined flow rate has the smallest value for a sum of the compressor power consumption and the blower power consumption.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method for controlling flow rate in a heating, ventilation, air conditioning and refrigeration (HVACR) system including one or more compressors and one or more blowers, comprising:

determining whether the HVACR system is in a partial load condition;

determining, using a processor, an operational flow rate by:

determining a compressor power consumption as a function of a flow rate, based on efficiency data for the one or more compressors;

determining a blower power consumption as a function of the flow rate, based on airflow power consumption data for the one or more blowers;

determining the flow rate having a value for a sum of the compressor power consumption and the blower power consumption that is less than a sum of the compressor power consumption and the blower power consumption at a rated minimum speed of the one or more blowers; and setting the flow rate having the value for a sum of the compressor power consumption and the blower power consumption as the operational flow rate; and when the HVACR system is in the partial load condition and at least one of the one or more compressors are in operation, operating the one or more blowers of the HVACR system at the determined operational flow rate.

2. The method of claim 1, wherein the operational flow rate is higher than a minimum flow rate for the one or more blowers of the HVACR system.

3. The method of claim 1, wherein the operational flow rate is determined based further on a humidity of air in the HVACR system.

4. The method of claim 1, wherein determining the operational flow rate comprises referencing a mathematical model correlating a compressor load with the operational flow rate based on the efficiency data for the one or more compressors and the airflow power consumption data for the one or more blowers of the HVACR system.

5. The method of claim 1, wherein the determined flow rate has the smallest value for a sum of the compressor power consumption and the blower power consumption.

6. The method of claim 1, wherein the HVACR system is a single-zone variable air volume HVACR system.

7. The method of claim 1, wherein the HVACR system is a multi-zone variable air volume HVACR system.

8. A heating, ventilation, air conditioning, and refrigeration (HVACR) system, comprising:

a refrigeration circuit including one or more compressors and a heat exchanger, the heat exchanger configured to exchange heat with air within the HVACR system;

one or more blowers; and a controller, configured to:

determine a compressor power consumption as a function of a flow rate, based on efficiency data for the one or more compressors;

determine a blower power consumption as a function of the flow rate, based on airflow power consumption data;

determine the flow rate having a value for a sum of the compressor power consumption and the blower power consumption that is less than a sum of the compressor power consumption and the blower power consumption at a rated minimum speed of the one or more blowers; and set the flow rate having the value for a sum of the compressor power consumption and the blower power consumption as an operational flow rate, and control the one or more blowers to provide the operational flow rate when the HVACR system is in a partial load condition and at least one of the one or more compressors is in operation.

9. The HVACR system of claim 8, wherein the determined flow rate has the smallest value for a sum of the compressor power consumption and the blower power consumption.

10. The HVACR system of claim 8, further comprising a plurality of VAV terminals, wherein each of the plurality of VAV terminals include dampers.

11. The HVACR system of claim 10, wherein the processor is configured to receive a state of the dampers of each of the plurality of VAV terminals, and the airflow power consumption data is specific to the state of the dampers of each of the plurality of VAV terminals.

12. The HVACR system of claim 8, wherein the operational flow rate is higher than a minimum flow rate for the one or more blowers of the HVACR system.

13. The HVACR system of claim 8, wherein the controller is configured to reference a mathematical model correlating a compressor load with the operational flow rate based on the efficiency data for the one or more compressors and the airflow power consumption data.

* * * * *